US006120418A

United States Patent [19]

Plough

[11] Patent Number: 6,120,418

[45] Date of Patent: Sep. 19, 2000

[54] SWING TRAINER

[76] Inventor: Bradley N. Plough, 3202 Cherry Hill Cir. S., Lakeland, Fla. 33810

[21] Appl. No.: 09/098,344

[22] Filed: Jun. 17, 1998

[51] Int. Cl.[7] ..... A63B 21/00

[52] U.S. Cl. ..... 482/69; 482/121; 482/124

[58] Field of Search ..... 473/277, 215, 473/216; 482/124, 121, 129, 69

[56] References Cited

U.S. PATENT DOCUMENTS

| | | | |
|---|---|---|---|
| 1,561,960 | 11/1925 | Ungar | 473/216 |
| 3,870,317 | 3/1975 | Wilson . | |
| 4,073,490 | 2/1978 | Feather . | |
| 4,593,909 | 6/1986 | Anselmn . | |
| 4,863,163 | 9/1989 | Wehrell . | |
| 5,026,065 | 6/1991 | Bellagamba . | |
| 5,048,836 | 9/1991 | Bellagamba | 473/216 |
| 5,221,241 | 6/1993 | Bare, II | 482/124 |
| 5,358,250 | 10/1994 | Spencer . | |
| 5,512,029 | 4/1996 | Barnard et al. | 482/124 |

*Primary Examiner*—Jerome Donnelly
*Attorney, Agent, or Firm*—B. G. Colley

[57] ABSTRACT

A swing trainer for training and improving the swing of golfers and baseball players which comprises a base platform, a pair of post elements mounted on said base, a wide belt adapted to be worn around the waist of a trainee, and resilient means attached to each of the post elements and to said belt whereby one of said resilient means is attached to said belt at the rear side thereof and the other one of said resilient means is attached to one side thereof The post elements can be vertically adjusted and locked to suit the height of the golf or baseball trainee.

8 Claims, 5 Drawing Sheets

SWING TRAINER

BACKGROUND OF THE INVENTION

This invention relates to a device for training the user or trainee to swing the body and allow the hips to turn and not slide or shift. More specifically, the invention relates to a device which includes a platform with two upright posts, a waist belt with two resistant rubber bands attached to specific points on the belt and the upright posts. The device is particularly useful to increase the strength of a baseball player or golfer standing on the platform when the resistance of the rubber bands are increased by the addition of more bands or using bands of higher resistance.

In the past people have invented training aids for every aspect of the golf or baseball swing. This invention is designed to develop, build, and train muscle and muscle memory for the hip turn. The following patents, found in a prior art search, represent the best known prior art; U.S. Pat. No. 5,358,250 issued to Spencer; U.S. Pat. No. 5,048,836 issued to Bellagamba; U.S. Pat. No. 5,026,065 issued to Bellagamba; U.S. Pat. No. 3,870,317; issued to Wilson on Mar. 11, 1975.

Both the Bellagamba patents have a waist belt with resistant bands attached to the belt. Both bands are pulled in opposite directions to a stationary point. The waist belt and resistant bands are designed to keep the body held in position during the golf swing. With the bands attached to either side of the waist belt and pulled in opposite directions, it makes for a very restrictive golf swing and no weight shift from one side to the other. Therefore, this device is not effective for the proper weight shift and hip turn for an athletic golf swing or the like.

The Wilson patent discloses a waist belt for golfers or baseball batters with one resistant band attached to the back of the belt. The other end of the resistant band is attached to the high upper end portion of a vertically mounted ground stake. As the golfer turns to his right, the resistant band stretches and pulls all the golfers weight over to the right side, a must for the proper athletic golf swing. One problem encountered using the Wilson device is when the golfer turns to the right side bringing the golf club up from the ground, the resistant band or ground stake becomes an obstruction and would hinder the proper athletic golf swing. Yet another problem encountered is that the ground stake tends to pull over towards the golfer as he turns and applies tension on the resistant band. Therefore, the ground stake does not provide enough stability to keep the golfer in position during the golf swing.

The Spencer patent discloses a golfer wearing a waist belt with one resistant band attached to a mountable frame directly to the left side of the golfer. The other end of the resistant band is pulled across the front of the body and around the right side where the band is attached to the central back portion of the belt. As the golfer turns to the right as shown in FIG. 5 of the patent, the resistant band stretches, therefore pulling the swinger towards the mountable frame. This type of muscle and resistant band training keeps the swinger well short of getting all the body weight over the right side. This leads to inconsistent ball striking and an unbalanced finish.

SUMMARY OF THE INVENTION

It is my objective to provide a swing training device to produce a defined, consistent and very powerful hip turn. The proper hip turn is the foundation of an athletic swing. The present invention includes a durable platform which the golfer or baseball batter stands on. Two upright posts are securely fastened to the platform in strategic locations i.e. one behind the right foot of a right handed trainee and the other one next to the right side of the trainee. For left handed trainees, the reverse location is mandated. The trainee wears a waist belt with two resistant bands strategically located on the belt. One band is attached to the back of the belt and the other is attached to the right hand side of the belt or vice versa depending upon the handedness of the trainee. The other end of the bands are removably attachable to the upright posts.

DESCRIPTION OF THE PREFERRED EMBODIMENTS

Figure 1:
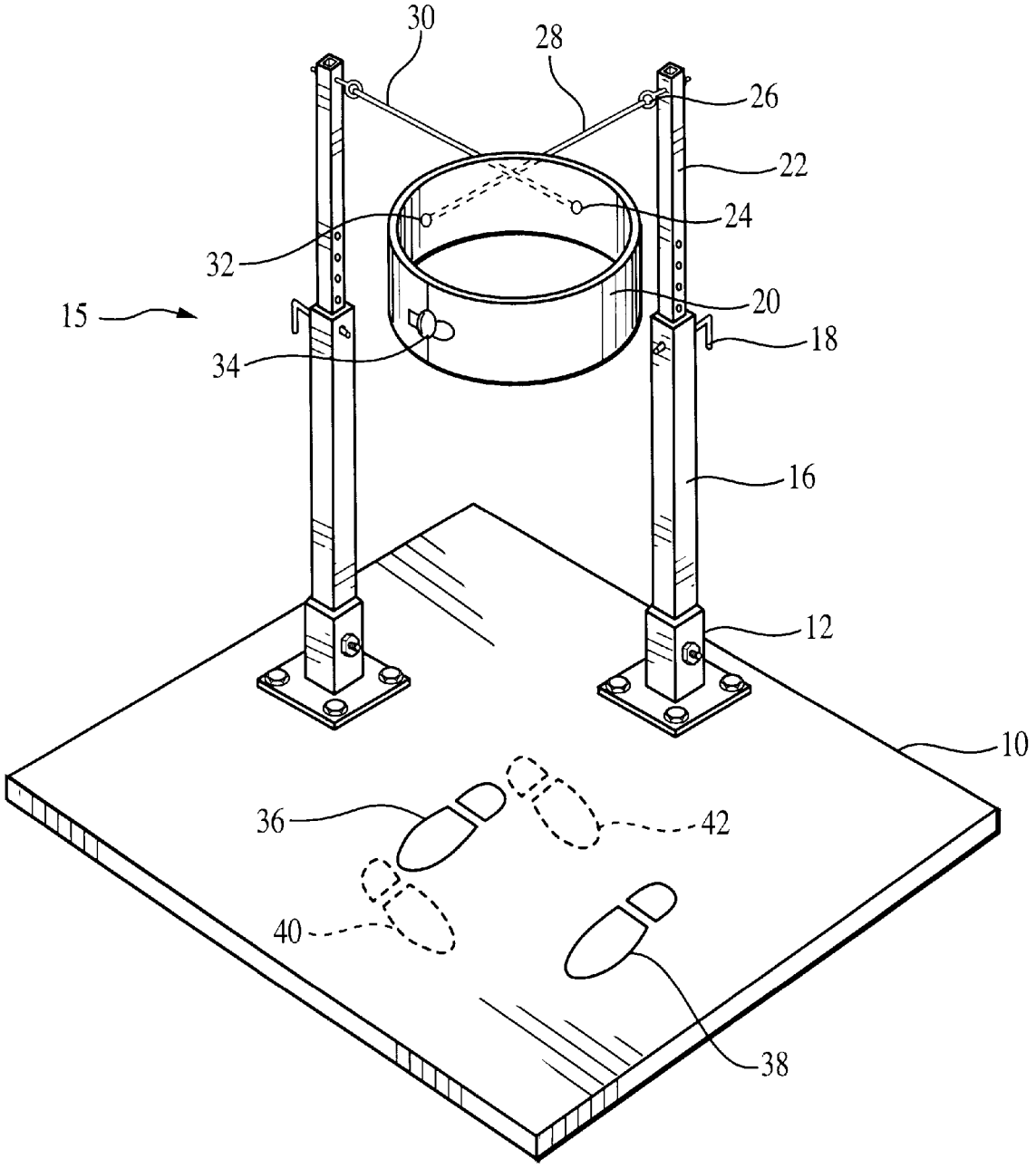
FIG. 1 A perspective view of the swing trainer illustrating the approximate location of the feet for right and left handed trainees in relation to the posts.

FIG. 1 of the drawings shows the base or platform 10 on which the telescoping posts, generally shown at 15, are mounted. The platform 10 can be made of laminated wood or molded plastic such as polyethylene and is made of a suitable thickness to give strength and rigidity. FIG. 1 outlines the ideal position of the feet of the trainee using the swing trainer. Thus, the solid "footprints" 36 and 38 denote the approximate position of a right handed golfer or base ball player and the phantom "footprints" 40 and 42 locate the approximate position of a left handed trainee or swinger.

The trainee (not shown in FIG. 1) straps on a wide waist belt 20 which is provided with a buckle 34 in the front. In the rear of the belt, a eyelet 24 is provided for attachment of the rear stretch band 30. A side eyelet 32 is provided for the attachment of the side stretch band 28. It is to be understood that the figures in the drawing illustrate a right handed swinger so that the side eyelet is on the right hand side of the belt 20. The reverse is true for a left handed swinger. If desired, the belt 20 can be equipped with two side eyelets. The stretch bands are preferably made of rubber and can be made thicker or thinner as is desired. If desired, the bands can be replaced by elongated coil springs to achieve the same resistance as the rubber bands.

Figure 2:
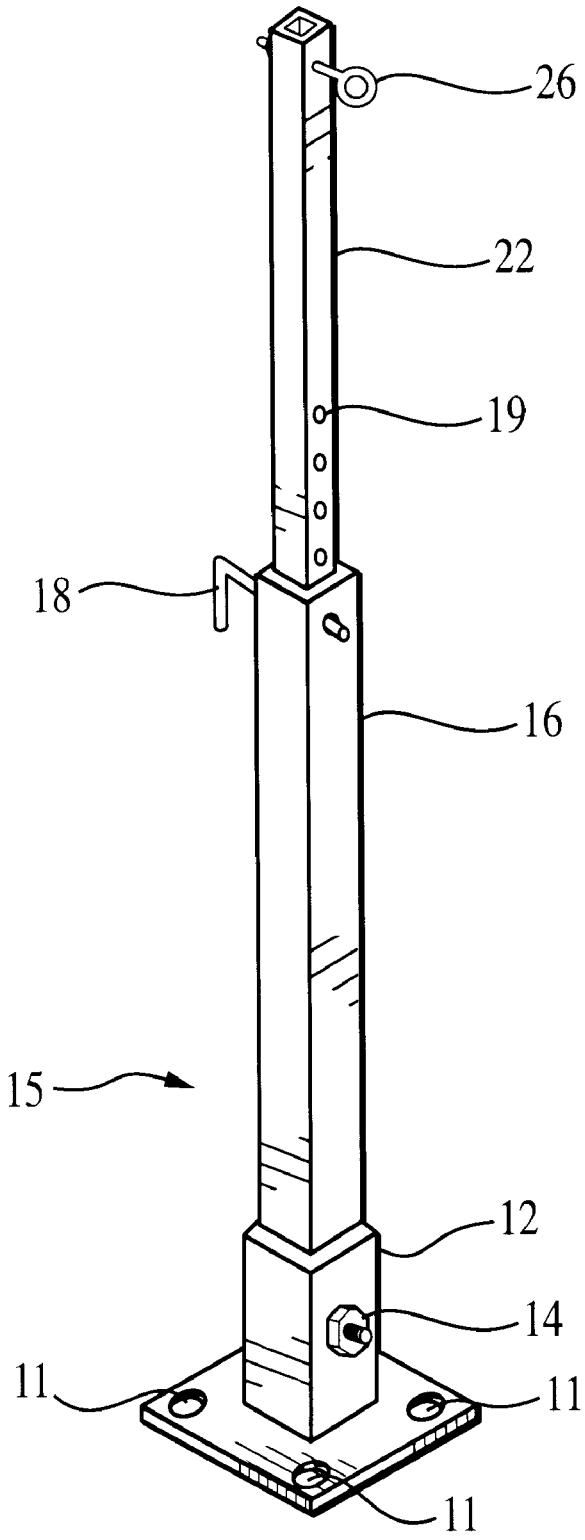
FIG. 2 An enlarged view of one post showing the details of the post.

FIG. 2 shows an enlarged view of the telescoping post 15 which has a base socket 12 which is mounted on the base 10 with a plurality of screws or bolts 11. A fixed shaft or tube 16 is secured in the socket 12 with a bolt and nut 14. A sliding tube 22 is placed inside the fixed tube 16 so that the tube 22 can be raised or lowered as the need arises and at the same time it can be locked in height by the adjustment pin 18 which works in conjunction with the adjustment holes 19 in the tube 22. If desired, the pin 18 can be replaced with a bolt and wing nut. The sliding tube 22 and the fixed tube 16 are shown to be square in cross-section but it is to be understood that circular tubes can be substituted if it is desired. On the upper end of the sliding tube 22 is mounted an eye bolt 26 for the attachment of the stretch bands.

Figure 3:
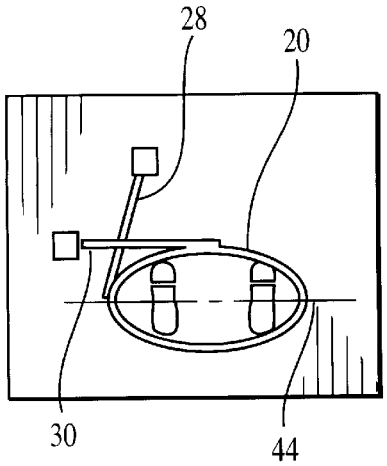
FIG. 3 A top view of the swing trainer showing the at-rest position of the waist belt on a right handed trainee in relation to his feet.

FIG. 3 is a top view showing the center-line 44 of the waist belt 20 of a trainee (not shown) in the at-rest position with the stretch bands 28 and 30 attached to the telescoping posts 15.

Figure 4:
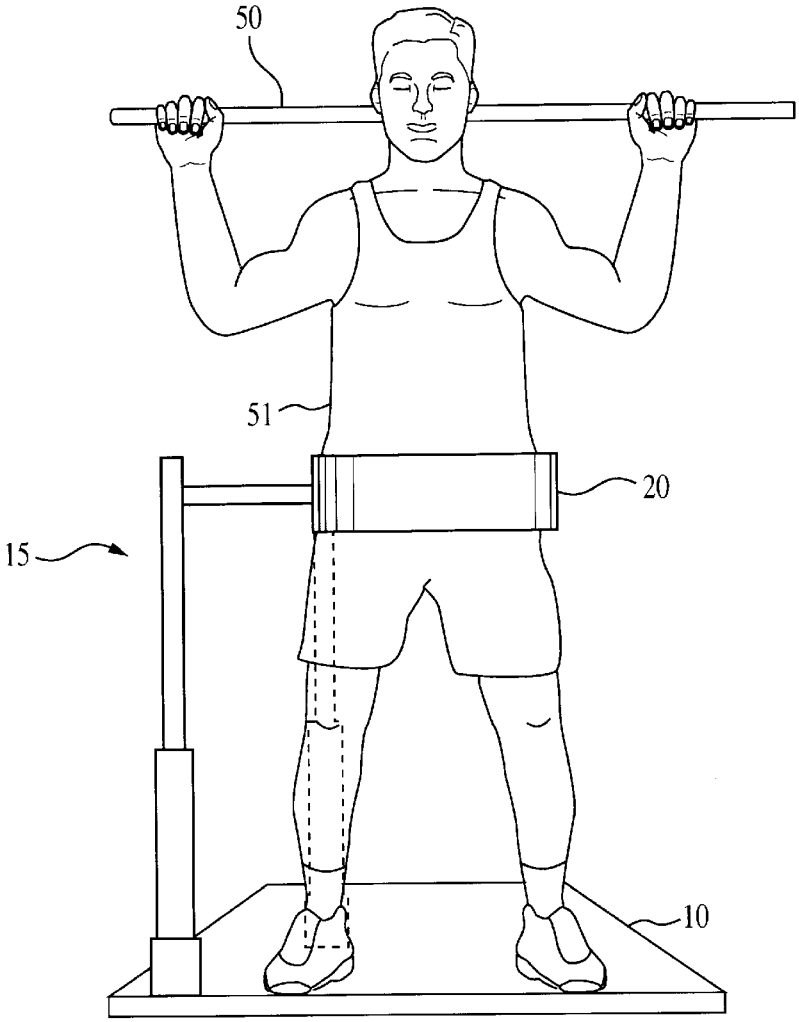
FIG. 4 A front view showing the at-rest position of a right handed trainee with a pole to position his arms.

FIG. 4 is a front view showing a trainee or swinger 51 at-rest and holding a pole 50 to maintain his arms upright while the waist belt 20 is attached to the telescoping posts 15.

Figure 5:
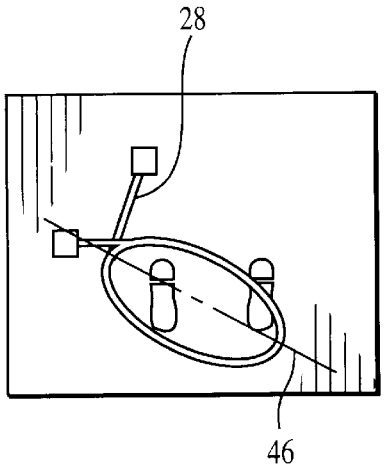
FIG. 5 A top view showing the position of the waist belt on a trainee in relation to his feet at the beginning of a swing to the right.

FIG. 5 is a top view similar in scope to FIG. 3 in that it shows the center-line 46 of a trainee beginning a swing or turn to the right.

Figure 6:
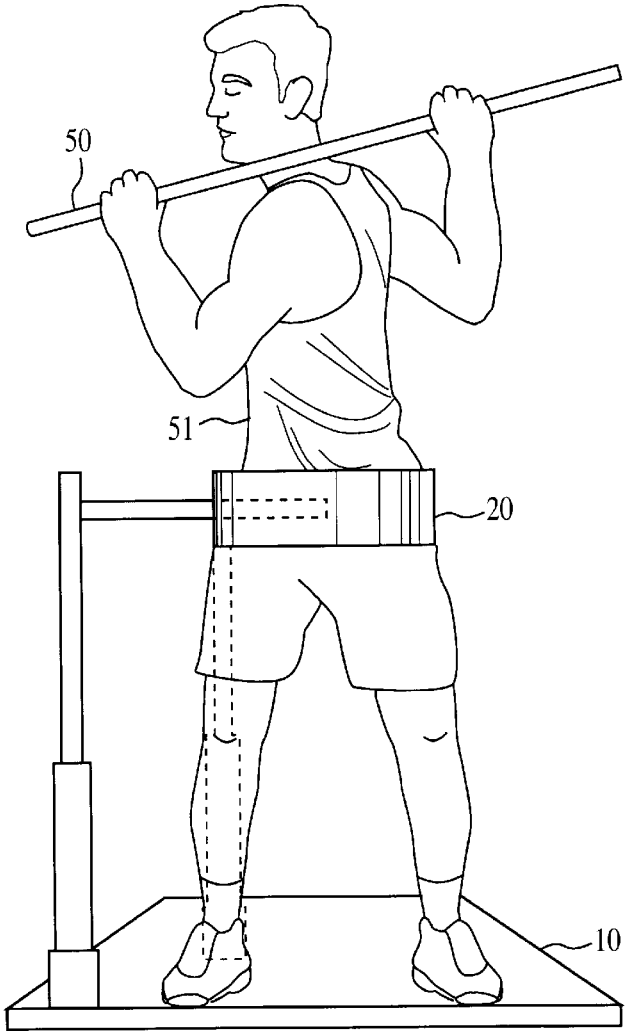
FIG. 6 A front view showing the position of a right handed trainee with a pole at the beginning of a swing to the right.

FIG. 6 is a front view similar in scope to FIG. 4 in that it shows a trainee beginning a swing to the right.

Figure 7:
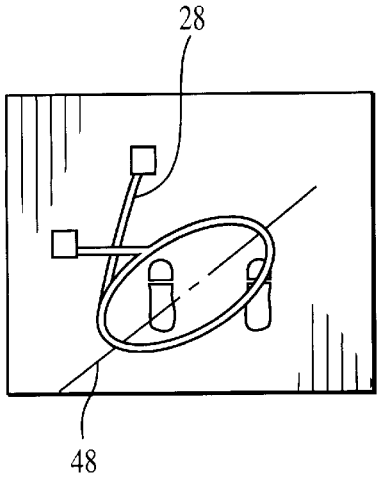
FIG. 7 A top view showing the position of the waist belt on a trainee in relation to his feet at the beginning of a swing to the left.

FIG. 7 is a top view similar in scope to FIG. 3 in that it shows the center-line 48 of a trainee beginning a swing or turn to the left.

Figure 8:
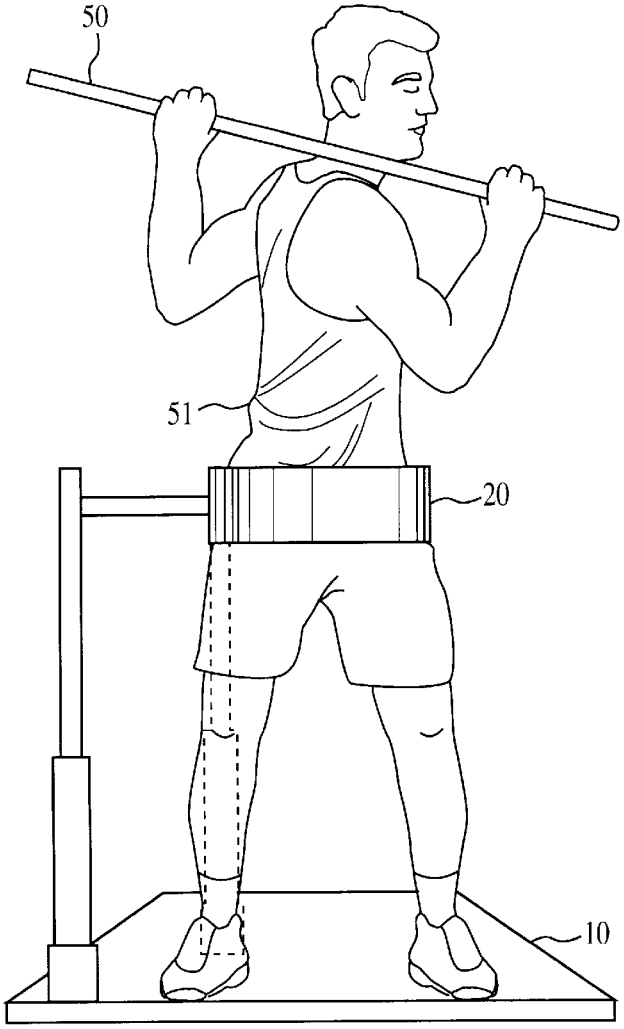
FIG. 8 A front view showing the position of a right handed trainee holding a pole at the beginning of a swing to the left.

FIG. 8 is a front view similar in scope to FIG. 4 in that it shows a trainee beginning a swing to the left.

In use of the device, a trainee holds a golf club or a pole across the shoulders as shown in FIG. 3 to isolate the hips. When the trainee turns to the right as shown in FIG. 5, band 28 relaxes and band 30 is stretched. Thus, the body weight of the trainee is pulled into the correct position. After the trainee completes his swing to the right as shown in FIG. 5, the trainee turns to the left as shown in FIG. 7 whereupon band 30 begins to relax but not completely and this keeps the trainee from sliding to the left which is known as a lateral shift. Now, band 28 stretches, adding resistance to the turn. This kind of resistant band training develops, builds, and trains muscles and muscle memory for the hip turn.

I claim:

1. A swing trainer which comprises

A) a base platform,

B) a pair of post elements mounted on said base,

C) a wide belt adapted to be worn around the waist of a trainee, and

D) resilient means attached to each of the post elements and to said belt whereby one of said resilient means is attached to said belt at the rear side thereof and the other one of said resilient means is attached to one side thereof.

2. A swing trainer as set forth in claim 1 wherein said post elements are adjustable in height.

3. A swing trainer as set forth in claim 1 wherein said resilient means are removable.

4. A swing trainer as set forth in claim 1 wherein said post elements comprise A) a base socket, B) a fixed tube mounted in said socket with release means, C) a telescoping tube mounted in said fixed tube, and D) locking means to secure the height adjustment of said telescoping tube.

5. A swing trainer which comprises

A) a base platform,

B) a pair of tubular elements attached to said base with tubular sockets,

C) a wide belt adapted to be worn around the waist of a trainee, and

D) resilient means attached to each of the tubular elements and to said belt whereby one of said resilient means is attached to said belt at the rear side thereof and the other one of said resilient means is attached to said belt at the right side of a right-handed trainee or attached to the left side of a left-handed trainee.

6. A swing trainer as set forth in claim 5 wherein said tubular elements are adjustable in height.

7. A swing trainer as set forth in claim 5 wherein said tubular elements comprise A) a fixed tube mounted in said tubular socket, B) a telescoping tube Mounted in said fixed tube, and C) locking means to secure the height adjustment of said tubular element.

8. A swing trainer as set forth in claim 7 wherein the locking means comprises A) said telescoping tube with a plurality of spaced holes, B) said fixed tube with a single hole, and C) a locking pin which penetrates the holes in said telescoping tube and fixed tube.

* * * * *